US006655772B2

(12) United States Patent
Danzuka et al.

(10) Patent No.: US 6,655,772 B2
(45) Date of Patent: Dec. 2, 2003

(54) PRINTING APPARATUS AND PRINTHEAD TEMPERATURE MANAGEMENT METHOD

(75) Inventors: Toshimitsu Danzuka, Kanagawa (JP); Yoshihiro Takada, Tokyo (JP); Kenshi Hata, Tokyo (JP); Katsushi Hara, Kanagawa (JP); Yukimichi Someya, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/100,139

(22) Filed: Mar. 19, 2002

(65) Prior Publication Data

US 2002/0140753 A1 Oct. 3, 2002

(30) Foreign Application Priority Data

Mar. 21, 2001 (JP) ..... 2001-081442

(51) Int. Cl.[7] ..... B41J 29/38
(52) U.S. Cl. ..... 347/14; 347/17
(58) Field of Search ..... 347/14

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 4,910,528 A | | 3/1990 | Firl et al. | |
| 5,166,699 A | * | 11/1992 | Yano et al. | 347/17 |
| 5,610,638 A | * | 3/1997 | Courtney | 347/14 |
| 5,917,519 A | * | 6/1999 | Arai et al. | 347/41 |
| 5,986,684 A | * | 11/1999 | Ohashi | 347/194 |
| 6,315,379 B1 | * | 11/2001 | Adams et al. | 347/14 |

FOREIGN PATENT DOCUMENTS

| | | | |
|---|---|---|---|
| EP | 0 694 394 A1 * | 1/1996 | B41J/2/05 |
| EP | 0 876 917 A2 * | 11/1998 | B41J/2/05 |
| JP | 59-123670 | 7/1984 | B41J/3/04 |
| JP | 59-138461 | 8/1984 | B41J/3/04 |
| JP | 4-219247 | 8/1992 | B41J/2/12 |

* cited by examiner

*Primary Examiner*—Benjamin R. Fuller
*Assistant Examiner*—Alfred Dudding
(74) *Attorney, Agent, or Firm*—Fitzpatrick, Cella, Harper & Scinto

(57) ABSTRACT

A printing apparatus in which a printhead and a print medium intermittently move relatively to each other, and the printhead performs printing on the print medium during the relative movement. The temperature of the printhead is detected, the detected temperature is compared with a predetermined threshold value, and start of new relative movement accompanied by printing is controlled in correspondence with the result of comparison. The threshold value is set in correspondence with information regarding the number of pixels for which the printhead can perform printing during one relative movement. By this arrangement, reduction of output speed can be suppressed as much as possible, and inconveniences due to temperature rise of the printhead can be prevented.

23 Claims, 8 Drawing Sheets

PRINTING APPARATUS AND PRINTHEAD TEMPERATURE MANAGEMENT METHOD

FIELD OF THE INVENTION

The present invention relates to a printing apparatus and a printhead temperature management method, and more particularly, to printhead temperature control in a printing apparatus for performing printing on a print medium by a printhead.

BACKGROUND OF THE INVENTION

As a printing apparatus which is an information output apparatus in a word processor, a personal computer, a facsimile machine and the like, for outputting information of desired characters, images and the like on a sheet type print medium such as a print sheet or a film, a serial printing-type printing apparatus, which performs printing while reciprocate-scanning a printhead in a direction orthogonal to a conveyance direction of a print medium such as a print sheet, is widely used since it has advantages in its low price, reduced size and the like.

Conventionally, such printing apparatus has been widely studied and developed. For example, an ink-jet printing apparatus using an ink-jet printhead, a thermal transfer printing apparatus using a thermal printhead and the like are widely used.

In many of such printing apparatuses, as printing progresses, i.e., as the printhead is driven, the temperature of the printhead rises. When the temperature of the printhead goes into an overheated status, inconveniences occur in a printed image and the like.

To prevent this status, in some apparatuses, if a detected temperature of the printhead is equal to or higher than a predetermined value, the printing speed is lowered, i.e., the maximum drive frequency for the printhead is lowered, or printing is temporarily suspended in a standby status for a predetermined period, thereby the printhead is prevented from going into the overheated status.

However, if the maximum drive frequency for the printhead is lowered, the speed of relative movement between the printhead and the print medium upon printing must also be lowered. Thus, the construction of the drive mechanism and the control circuit and the like becomes complicated, and the cost of the entire apparatus increases.

Further, in a case where printing is temporarily suspended in the standby status for a predetermined period, if the standby period is long, the output speed is lowered in the extreme.

SUMMARY OF THE INVENTION

The present invention has as an object to provide a printing apparatus which prevents inconveniences due to temperature rise of the printhead while suppressing reduction of output speed as much as possible by a low-cost simple construction and control.

The above-described object is attained by providing a printing apparatus in which a printhead and a print medium intermittently move relatively to each other, and during a relative movement, the printhead performs printing on the print medium, comprising: temperature detection means for detecting a temperature of the printhead; comparison means for comparing the temperature detected by the temperature detection means with a predetermined threshold value; control means for controlling start of new relative movement accompanied by printing in correspondence with the result of comparison by the comparison means; and threshold value setting means for setting the threshold value in correspondence with information regarding the number of pixels for which the printhead can perform printing during one relative movement.

Another object of the present invention is to provide a printhead temperature management method for preventing inconveniences due to temperature rise of printhead while suppressing reduction of output speed as much as possible by a low-cost simple construction and control.

The above-described object is attained by providing a printhead temperature management method for a printing apparatus in which a printhead and a print medium intermittently move relatively to each other, and during a relative movement, the printhead performs printing on the print medium, comprising: a temperature detection step of detecting a temperature of the printhead; a comparison step of comparing the temperature detected by the temperature detection means with a predetermined threshold value; a control step of controlling start of new relative movement accompanied by printing in correspondence with the result of comparison by the comparison means; and a threshold value setting step of setting the threshold value in correspondence with information regarding the number of pixels for which the printhead can perform printing during one relative movement.

According to the present invention, in the printing apparatus, in which the printhead and the print medium intermittently move relatively to each other, and the printhead performs printing on the print medium during the relative movement, the temperature of the printhead is detected, then the detected temperature is compared with a predetermined threshold value, and the start of new relative movement accompanied by printing is controlled in accordance with the result of comparison. The threshold value is set in accordance with information regarding the number of pixels for which the printhead can perform printing during one relative movement.

According to the construction, if the temperature of the printhead is equal to or higher than the threshold value set in accordance with the information regarding the number of pixels for which the printhead can perform printing during one relative movement, the new relative movement accompanied by printing is not performed.

Accordingly, as a complicated construction and control are unnecessary, inconveniences due to temperature rise of the printhead can be prevented while the reduction of output speed is suppressed as much as possible.

In this case, if the control means controls so as not to start the new relative movement accompanied by printing while the temperature is equal to or higher than the threshold value, the occurrence of inconveniences due to the temperature rise of the printhead can be effectively prevented.

Further, it is preferable that the threshold value setting means includes a table of correspondence between the information and the threshold values.

Further, the information regarding the number of pixels for which the printhead can perform printing during one relative movement may be information on the length in the direction of relative movement in an area, where the printhead performs printing during the one relative movement, or information based on whether a printing mode for divisionally printing an area where the printhead can perform printing during the one relative movement with printing during plural relative movements is set or not, or information based on a division number for the divisional printing during plural relative movements.

Further, the information may be information based on the maximum number of dots for which the printhead can perform printing during the one relative movement.

It is further preferable that the printing apparatus further comprises environmental temperature detection means for detecting an environmental temperature around the printhead, and that the threshold value setting means sets the threshold value in correspondence with the information and the environmental temperature.

In addition, in a case where the apparatus has plural printheads, it is preferable that the respective printheads have the temperature detection means, and the comparison means compares the detected maximum temperature and the threshold value.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, the term "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

[First Embodiment]

Figure 1:
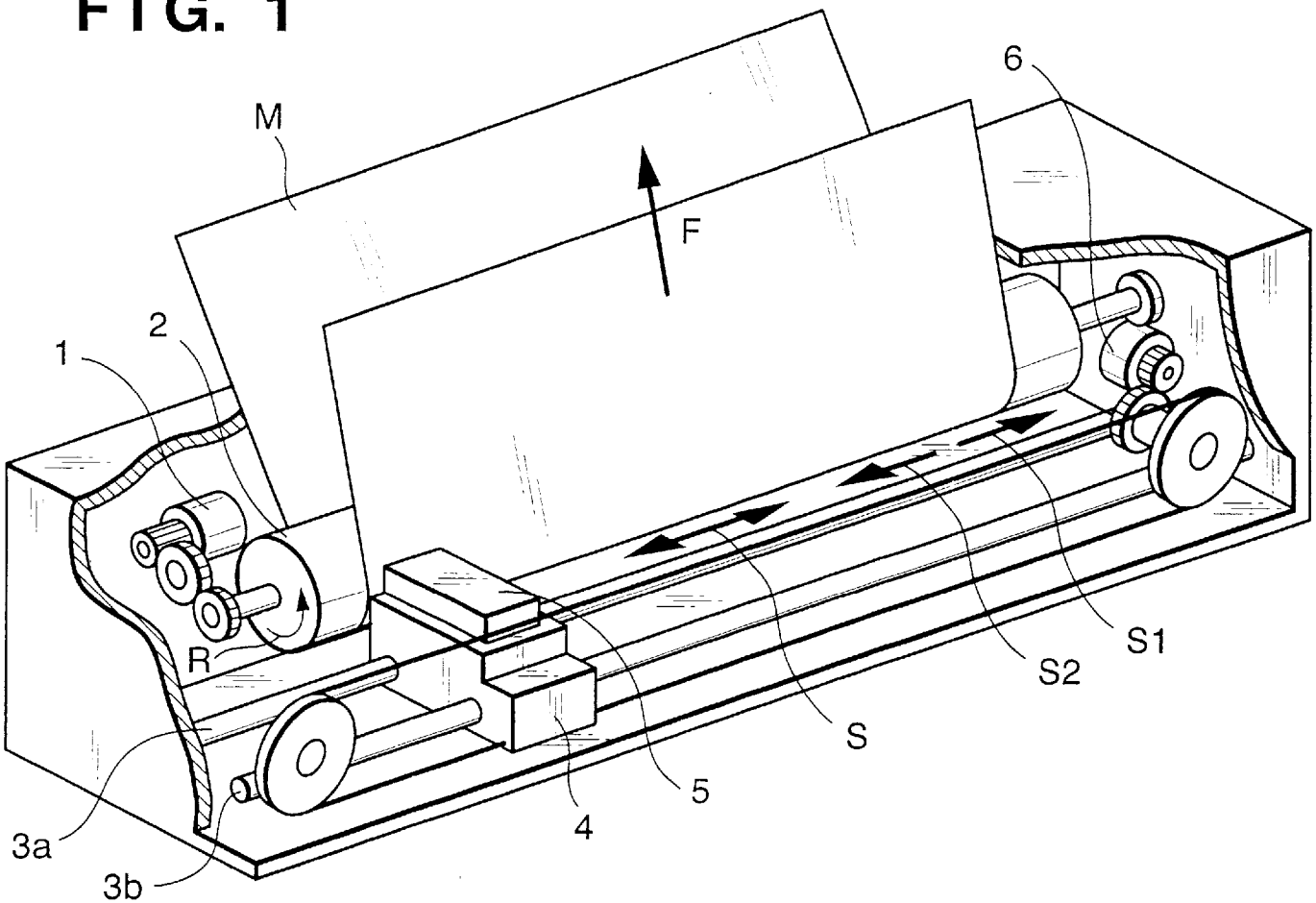
FIG. 1 is a perspective view showing the construction of an ink-jet printer according to a first embodiment of the present invention.

FIG. 1 is a perspective view showing the construction of an ink-jet printer according to a first embodiment of the present invention.

In FIG. 1, a print medium (hereinbelow also referred to as a "medium") M is conveyed in an arrow F direction in the figure by a platen roller 2 and a conveyance roller group (not shown), in accordance with rotation drive of a conveyance motor 1.

Parallel guide shafts 3*a* and 3*b* are provided in a direction orthogonal to a conveyance direction (subscanning direction) of the medium M, and a carriage 4 on which an ink-jet printhead 5 is mounted is reciprocated (scanned) in an arrow S direction (main scanning direction) in the figure by drive of the carrier motor 6.

The medium M is intermittently conveyed by the conveyance motor 1. When the medium M is stopped, the ink-jet printhead 5 is reciprocate-scanned in the main scanning direction, and during the scanning, the printhead discharges ink droplets in correspondence with print data, thereby printing is performed.

In the ink-jet printhead 5, 256 discharge orifices (nozzles) are arrayed with a pitch of 600 dpi (dot per inch) in the subscanning direction. In ink channels communicated with the respective discharge orifices, an electrothermal transducer is provided to partially heat ink to cause film boiling and to discharge the ink by the pressure of the film boiling.

Further, in the ink-jet printhead 5, a diode sensor 50 (See FIG. 2) for temperature detection is provided on the same substrate where the electrothermal transducers are provided.

Figure 2:
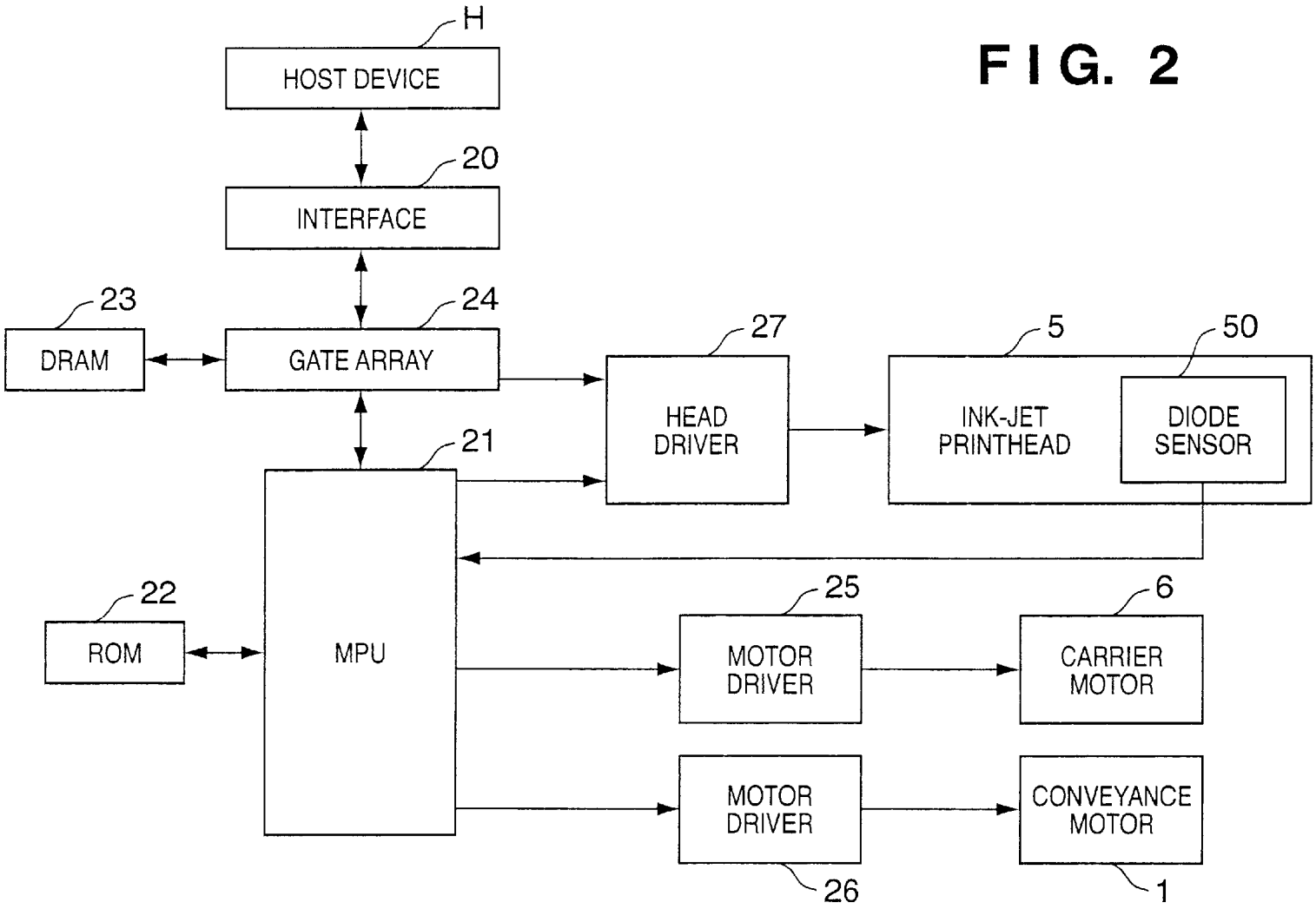
FIG. 2 is a block diagram showing an arrangement of a control circuit of the ink-jet printer shown in FIG. 1.

FIG. 2 is a block diagram showing an arrangement of a control circuit of the ink-jet printer shown in FIG. 1. In FIG. 2, reference numeral 20 denotes an interface for transmission/reception of data such as image data and control command with a host device H; 21, an MPU which performs various control procedures and the like; 22, a ROM in which programs corresponding to the control procedures performed by the MPU, fixed data and the like, are stored; and 23, a DRAM in which various data (print data and the like to be supplied to the ink-jet printhead 5) are temporarily stored.

Numeral 24 denotes a gate array which controls print data supply to the ink-jet printhead 5 and controls data transfer among the interface 20, the MPU 21 and the DRAM 23; 25 and 26, motor drivers which drive a carrier motor 6 and the conveyance motor 1; and 27, a head driver which drives the ink-jet printhead 5.

Further, numeral 50 is the diode sensor which detects the temperature of the ink-jet printhead 5. Detected data is sent to the MPU 21.

Next, printing of 1 page image in an image printing sequence according to the present embodiment will be described with reference to the flowchart of FIG. 3, and FIGS. 1, 2 and 4.

Figure 3:
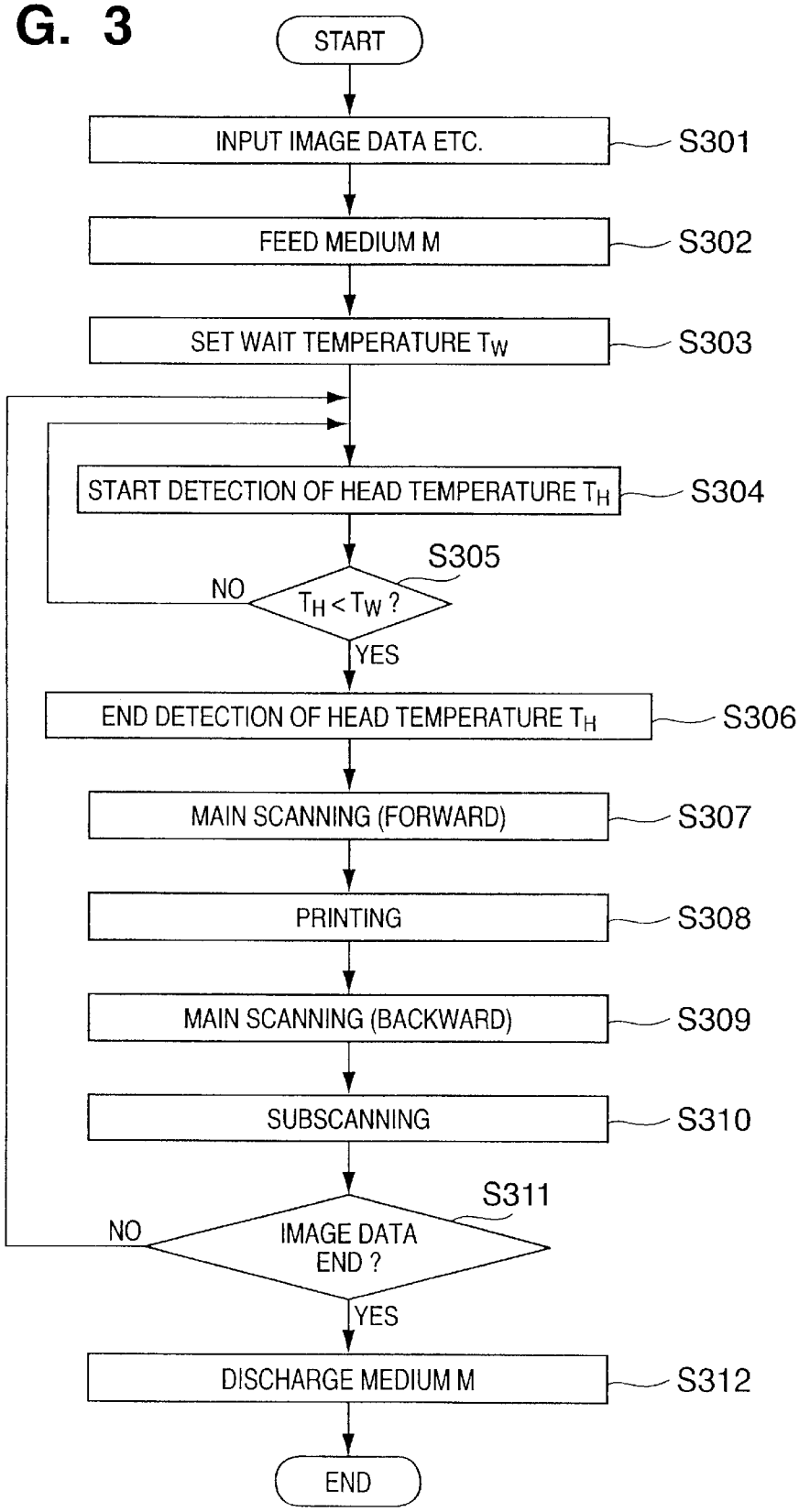
FIG. 3 is a flowchart showing an image printing sequence according to the first embodiment of the present invention.

In FIG. 3, when image data including control data is inputted from the host device H (step S301), the ink-jet printer of the present embodiment drives the conveyance motor 1 and the like, to feed the medium M to a predetermined print start position (step S302).

Figure 4:
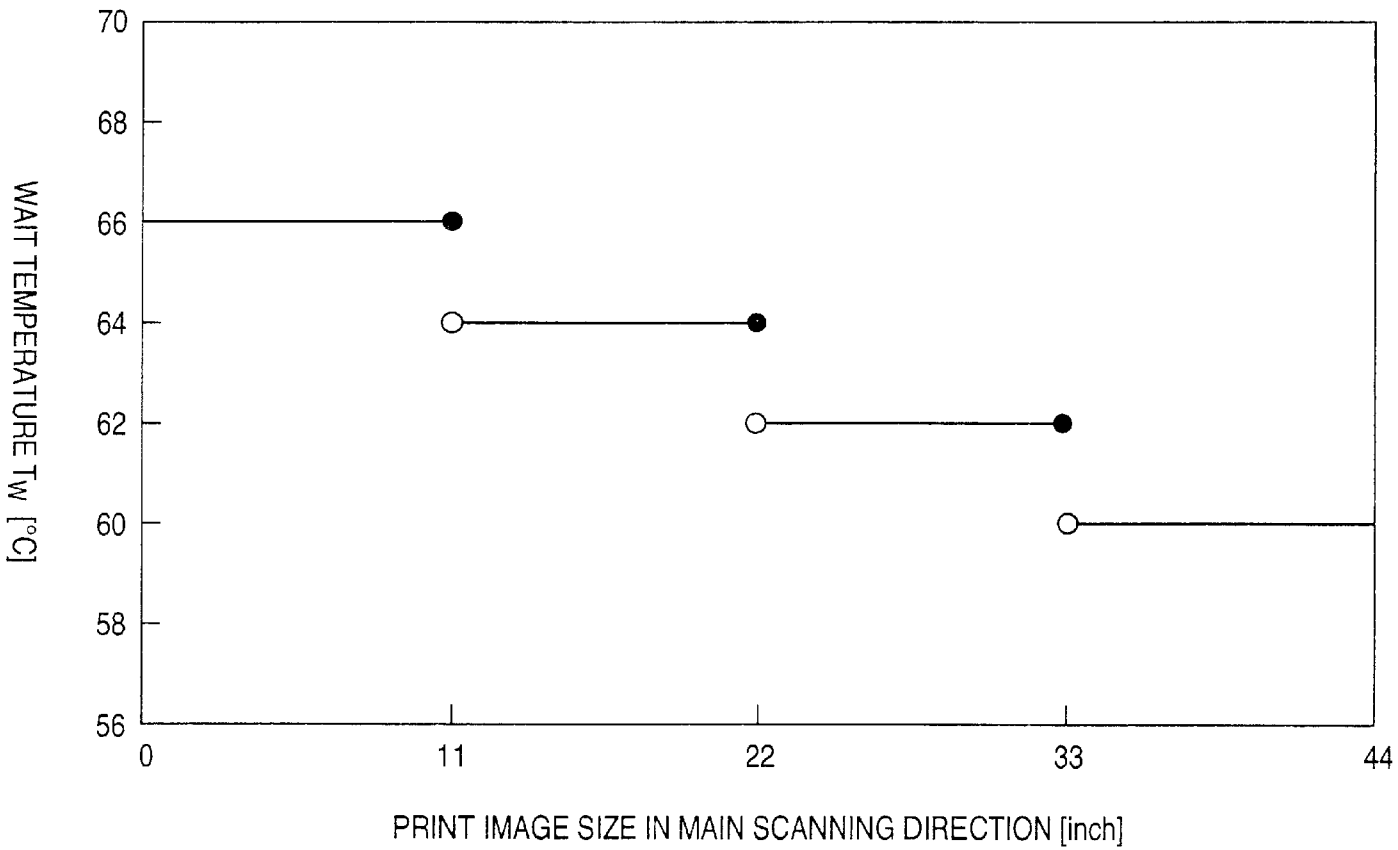
FIG. 4 is a table used in wait temperature setting according to the first embodiment.

Thereafter, the MPU 21 sets a threshold value (hereinbelow referred to as a "wait temperature $T_W$") used for control to delay start of new main scanning accompanied by ink discharge (printing) by the ink-jet printhead 5, by using a table as shown in FIG. 4, stored in the ROM 22, in accordance with main-scanning directional size data of the print image included in the control data (step S303).

Later, the threshold value (wait temperature $T_W$) is compared with the temperature of the ink-jet printhead 5 (hereinbelow referred to as a "head temperature $T_H$") detected by the diode sensor 50 (step S305).

Next, a method of generating the table in FIG. 4 will be described below. In the present embodiment, the speed of main scanning while the ink-jet printhead 5 performs ink discharge (printing) is 10 inches/second (hereinbelow inch/s) and controlled to be approximately constant. In addition, the maximum drive (ink discharge) frequency of the ink-jet printhead 5 is 6 KHz.

Further, as described above, the ink-jet printhead 5 of the present embodiment has arrayed 256 discharge orifices with a 600 dpi pitch in the subscanning direction. The amount of subscanning (conveyance of the medium M) after the main scanning accompanied by ink discharge (printing) by the ink-jet printhead 5 corresponds to the maximum subscanning-directional length of print area where the ink-jet printhead 5 can perform printing per one main scanning, i.e., (256/600) inches.

Accordingly, the resolution of the ink-jet printer of the present embodiment is 600 dpi (main scanning direction)× 600 dpi (subscanning direction).

In the ink-jet printer as described above, the maximum number of dots for which the ink-jet printhead 5 can perform printing during one main scanning is uniquely determined in correspondence with the size of print image in the main scanning direction. Further, time required for printing the maximum number of dots is uniquely determined.

Accordingly, if start of new main scanning accompanied by printing (ink discharge) is delayed until the temperature of the ink-jet printhead 5 (head temperature $T_H$) detected by the diode sensor 50 becomes lower than the wait temperature $T_W$, the maximum value of the head temperature $T_H$ during the image printing is approximately determined in correspondence with the main-scanning directional size of the print image.

If the head temperature $T_H$ is too high, the ink-jet printer of the present embodiment has inconveniences as described below.

When the ink-jet printhead 5 is driven so as to perform printing, the head temperature $T_H$ rises by the drive (ink discharge). At the same time, the temperature of ink in the ink-jet printhead 5 also rises. As the ink temperature rises, gaseous solution in the ink is precipitated, and accumulated as bubbles in the ink channels and a common ink chamber communicated with the respective ink channels.

Then, when the bubbles disturb ink supply to the common ink chamber, discharge failure occurs in all the discharge orifices.

Accordingly, the ink-jet printer of the present embodiment is controlled such that the maximum temperature of the ink-jet printhead 5 during printing is a predetermined value (about 70° C. in the present embodiment).

The wait temperature $T_W$ corresponding to the main-scanning directional size as information regarding the number of pixels to be printed in the print image, at which the maximum temperature of the ink-jet printhead 5 during image printing does not exceed the predetermined value, is obtained by a relational expression obtained from experiment or several measurements, and the table as shown in FIG. 4 is generated.

Note that in the ink-jet printer of the present embodiment, an image larger than 44 inches in the main scanning directional size cannot be printed.

The wait temperature $T_W$ is set in correspondence with the main-scanning directional size of print image by using the generated table (step S303). Thereafter, detection of the head temperature $T_H$ is started (step S304), and it is determined whether or not the detected head temperature $T_H$ is lower than the wait temperature $T_W$ (step S305).

If NO at step S305, i.e., the head temperature $T_H$ is equal to or higher than the wait temperature $T_W$, the process returns to step S304, and the detection of the head temperature $T_H$ and determination at step S305 are performed. That is, the process stands by until the head temperature $T_H$ becomes lower than the wait temperature $T_W$.

On the other hand, if YES at step S305, i.e., the head temperature $T_H$ is lower than the wait temperature $T_W$, the detection of the head temperature $T_H$ is ended (step S306), then the carriage 4 as shown in FIG. 1 starts main scanning toward the arrow S1 direction (hereinbelow, "forward direction") (step S307).

The carriage 4 which has started the forward main scanning is accelerated and controlled such that the main scanning speed is approximately constant speed of 10 inch/s before the ink-jet printhead 5 comes to the predetermined print (ink discharge) start position.

While the carriage 4 performs the main scanning at the approximately constant speed, the ink-jet printhead 5 performs printing by discharging ink droplets in correspondence with print data, from the predetermined print start position to a print end position corresponding to the main-scanning directional size data of the print image (step S308).

Thereafter, the carriage 4 is decelerated, and when the forward main scanning is completed and the carriage is stopped, it turns, then performs main scanning in an arrow S2 direction in FIG. 1 (hereinbelow "backward direction") (step S309), to return to the carriage home position side.

During the scanning, the medium M is subscan-moved by the maximum length in the subscanning direction in the area where the ink-jet printhead 5 can perform printing in the forward main scanning, i.e., (256/600) inches (step S310).

As described above, when one reciprocate scanning has been completed, it is determined whether or not image data printing has been already completed (step S311). If NO, the process returns to step S304, to repeat the processing to step S311.

That is, printing by the ink-jet printhead 5, subscanning and the like are repeated until the image data printing is completed while timing of start of main scanning is controlled in correspondence with comparison between the head temperature $T_H$ and the wait temperature $T_W$.

On the other hand, if YES at step S311, the medium M is discharged by drive of the conveyance motor 1 and the like (step S312).

As described above, in the present embodiment, the head temperature $T_H$ during image printing is maintained at a temperature not to cause the above-described inconveniences.

That is, an excellent print image can be obtained by the above simple construction and control, at a low cost, and reduction of the output speed can be suppressed, and further, the occurrence of above-described inconveniences can be prevented.

[Second Embodiment]

Hereinbelow, a second embodiment of the present invention will be described. In the following description, elements similar to those in the above-described first embodiment have the same reference numeral, explanations of the elements will be omitted, and a characteristic feature of the second embodiment will be mainly described.

In the first embodiment, a so-called 1-path printing method, the amount of subscanning performed after main scanning accompanied by printing corresponds to the maximum length in the subscanning direction of a print area where the printhead can perform printing in one main scanning. In the printer according to the second embodiment, the above 1-path printing method is employed in a high speed mode, and a so-called 2-path printing method is employed in a high image quality mode.

Next, the image printing sequence according to the present embodiment will be described with reference to the attached drawings.

In FIG. 3, when image data including control data is inputted from the host device H (See FIG. 2) (step S301), the ink-jet printer of the present embodiment drives the conveyance motor 1 (See FIGS. 1 and 2) and the like to feed the medium M to a predetermined print start position (step S302).

Then, the MPU 21 (See FIG. 2) sets the wait temperature $T_W$ in correspondence with the main-scanning directional size data of the print image and mode data indicating the high speed mode or the high image quality mode included in the control data (step S303).

At this time, if the mode data indicates the high speed mode, the table in FIG. 4 is used as in the case of the first embodiment. As the subsequent sequence is the same as that of the first embodiment, explanation of the subsequent sequence will be omitted.

Figure 5:
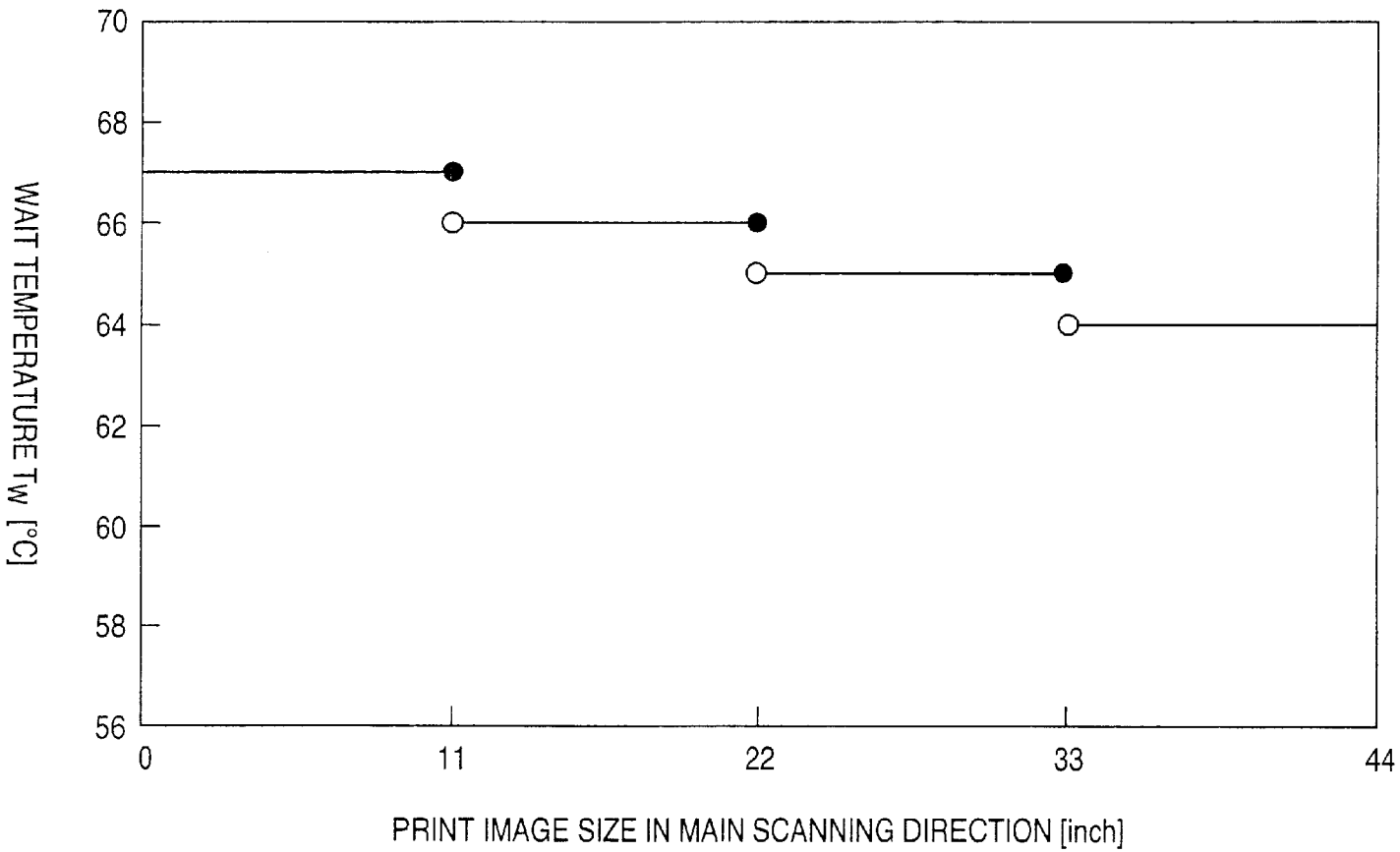
FIG. 5 is a table used in wait temperature setting for high image quality mode according to a second embodiment.

On the other hand, if the mode data indicates the high image quality mode, a table as shown in FIG. 5 is used for setting the wait temperature $T_W$ at step S303, since the 2-path printing method is employed in the high image quality mode. The details of the setting of the wait temperature $T_W$ at step S303 using the table in FIG. 5 will be described later.

When the wait temperature $T_W$ has been set, the detection of the head temperature $T_H$ is started (step S304), and it is determined whether or not the detected head temperature $T_H$ is lower than the wait temperature $T_W$ (step S305).

If NO at step S305, i.e., the head temperature $T_H$ is equal to or higher than the wait temperature $T_W$, the process returns to step S304, and the detection of the head temperature $T_H$ and determination at step S305 are performed. That is, the process stands by until the head temperature $T_H$ becomes lower than the wait temperature $T_W$.

On the other hand, if YES at step S305, i.e., the head temperature $T_H$ is lower than the wait temperature $T_W$, the detection of the head temperature $T_H$ is ended (step S306), then the carriage 4 as shown in FIG. 1 starts main scanning toward the arrow S1 direction (forward direction) (step S307).

The carriage 4 which has started the forward main scanning is accelerated and controlled such that the main scanning speed is approximately constant speed of 10 inch/s before the ink-jet printhead 5 comes to the predetermined print (ink discharge) start position.

While the carriage 4 performs the main scanning at the approximately constant speed, the ink-jet printhead 5 performs printing by discharging ink droplets in correspondence with print data, from the predetermined print start position to a print end position corresponding to the main-scanning directional size data of the print image (step S308).

Figure 6A:
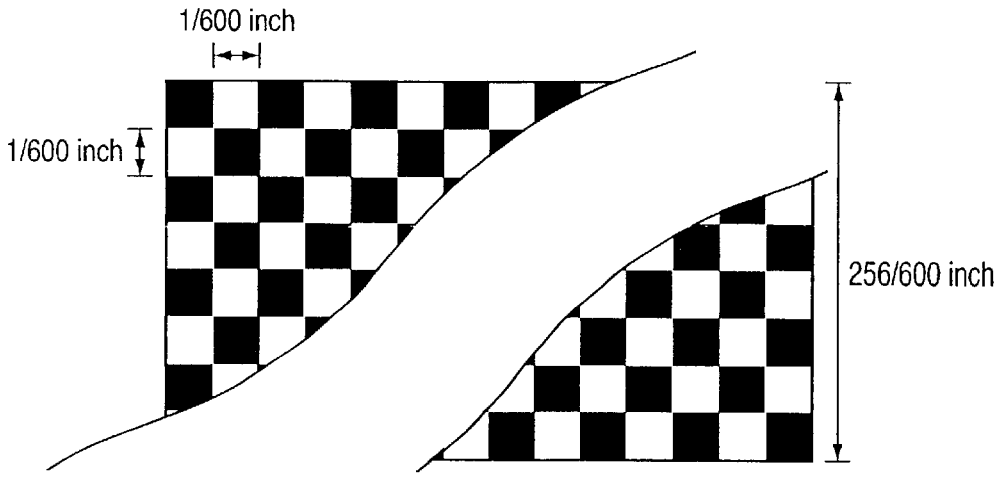
FIGS. 6A and 6B are examples of masks used in the high image quality mode according to the second embodiment of the present invention.
Figure 6B:
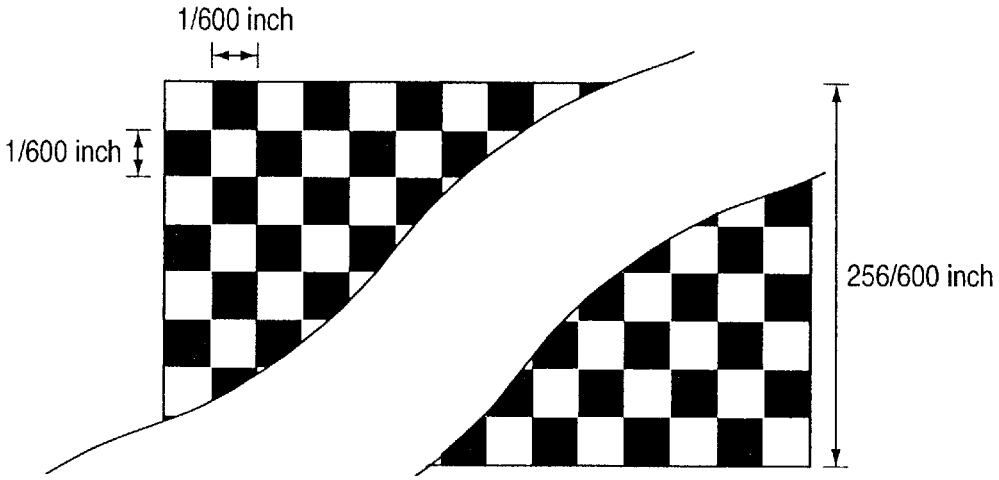

At this time, the maximum drive (ink discharge) frequency of the ink-jet printhead 5 is 6 KHz, and masks as shown in FIGS. 6A and 6B are used. That is, printing (ink discharge) is not performed for pixels corresponding to solid black portions in FIGS. 6A and 6B.

Accordingly, in the high image quality mode (2-path printing method), the maximum number of dots for which the ink-jet printhead 5 can perform printing in one main scanning accompanied by printing is about one-half that in the high speed mode (1-path printing method) (since the number of pixels corresponding to the black portions and that corresponding to the white portions are the same).

For this reason, the table shown in FIG. 5 different from the table shown in FIG. 4 is employed for setting the wait temperature $T_W$ at step S303 in the high image quality mode (2-path printing method).

Note that the table shown in FIG. 5, is obtained by relational expression obtained from experiment or several measurements as in the case of the first embodiment.

When the printing (ink discharge) in the forward main scanning by the ink-jet printhead 5 has been completed, the carriage 4 is decelerated, and when the forward main scanning is completed, the carriage turns, then performs main scanning in the arrow S2 direction in FIG. 1 (backward direction) (step S309), to return to the carriage home position side.

During the scanning, the medium M is subscan-moved by the half of the maximum length in the subscanning direction in the area where the ink-jet printhead 5 can perform printing in the forward main scanning, i.e., (128/600) inches (step S310).

Thereafter, it is determined whether or not image data printing has been already completed (step S311). If NO, the process returns to step S304, to repeat the processing to step S311. That is, printing by the ink-jet printhead 5, subscanning and the like are repeated until the image data printing is completed while timing of start of main scanning is controlled in correspondence with comparison between the head temperature $T_H$ and the wait temperature $T_W$.

At this time, the mask used upon odd-numbered forward main-scanning printing (ink discharge) and that used upon even-numbered forward main-scanning printing (ink discharge) are different. The relation between these two masks is complementary (See FIGS. 6A and 6B).

Note that in the high image quality mode (2-path printing method), the above-described control suppresses occurrence of unevenness, stripes and the like of print image due to variation of amount of ink droplets discharged from the plural discharge orifices of the ink-jet printhead 5.

On the other hand, if YES at step S311, the medium M is discharged by drive of the conveyance motor 1 and the like (step S312).

In the present embodiment, by the above construction and control, in the high speed mode and in the high image quality mode, the head temperature $T_H$ during image printing can be maintained at a temperature not to cause the above-described inconveniences.

That is, as the wait temperature in the high image quality mode (2-path printing method) is set to be higher than that in the high speed mode (1-path printing method), the reduction of output speed in the high image quality mode in comparison with that in the high speed mode can be suppressed, and the occurrence of above-described inconveniences can be prevented in the high speed mode and high image quality mode, thus an excellent print image can be obtained.

[Third Embodiment]

Hereinbelow, a third embodiment of the present invention will be described.

The third embodiment is also an example for applying the present invention to an ink-jet printer with serial printing scheme, same as the first and the second embodiments.

Since the general construction and the arrangement of the control block of the third embodiment are same as shown in FIGS. 1 and 2, explanations of which will be omitted.

In the first and second embodiments, the wait temperature $T_W$ is set in accordance with the size of the print image in the main scanning direction or the control data included in the print image. In this embodiment, the wait temperature $T_W$ is set in accordance with the print image data itself, as described below.

The image printing sequence according to the present embodiment will be described with reference to a flowchart shown in FIG. 7 and FIGS. 1, 2 and 8.

Figure 7:
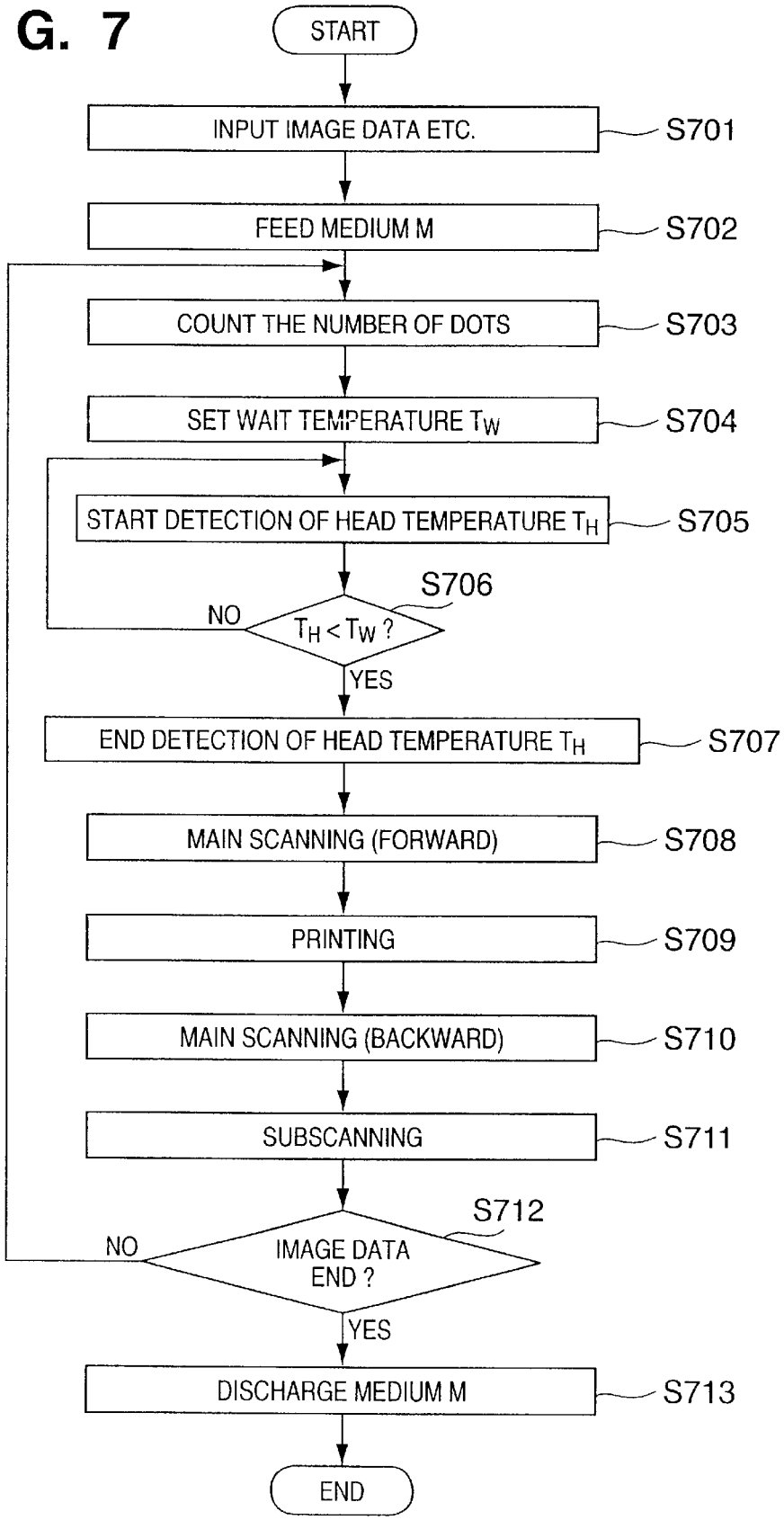
FIG. 7 is a flowchart showing an image printing sequence according to the third embodiment of the present invention.

In FIG. 7, when image data including control data is inputted from the host device H (See FIG. 2) (Step S701), the ink-jet printer of the present embodiment drives the conveyance motor 1 (See FIGS. 1 and 2) and the like to feed the medium M to a predetermined print start position (step S702).

Then, the MPU 21 (See FIG. 2) converts or translates the image data into print data to be supplied to the ink-jet printhead 5 (See FIGS. 1 and 2) and counts the number of dots (pixels) to be printed by the ink-jet printhead 5 during subsequent main scanning of the carriage 4 (See FIG. 1), and stores the counted result with the converted print data into the DRAM 23 (step S703).

Figure 8:
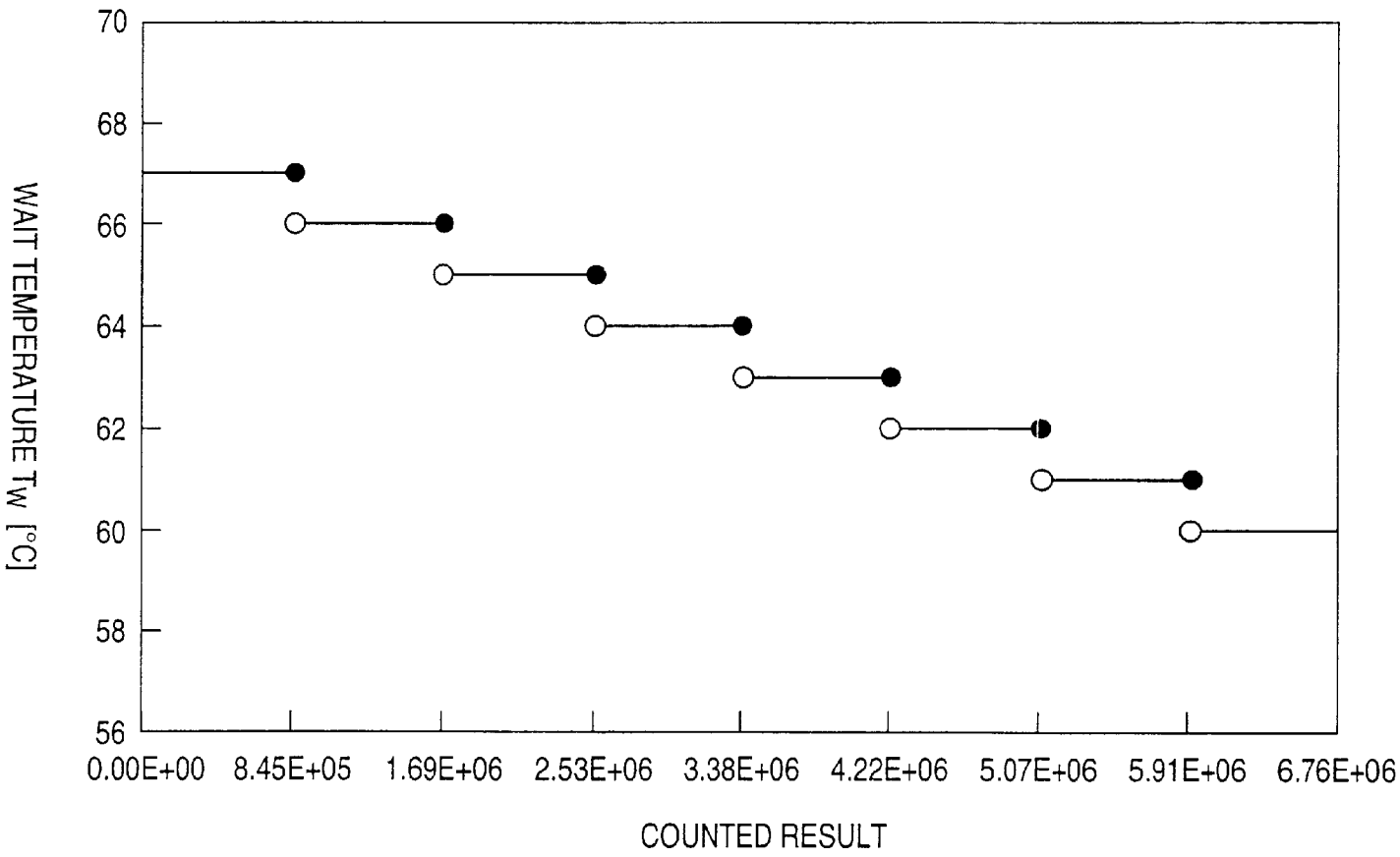
FIG. 8 is a table used in wait temperature setting according to the third embodiment of the present invention.

Next, the MPU 21 sets the wait temperature $T_W$ in accordance with the counted value (number of dots) by using a table such as shown in FIG. 8, which is stored in the ROM 22 (step S704).

After the setting of the wait temperature $T_W$, the detection of the head temperature $T_H$ is started (step S705), and it is determined whether or not the detected head temperature $T_H$ is lower than the wait temperature $T_W$ (step S706).

If NO at step S706, i.e., the head temperature $T_H$ is equal to or higher than the wait temperature $T_W$, the process returns to step S705, and the detection of the head temperature $T_H$ and determination at step S706 are performed. That is, the process stands by until the head temperature $T_H$ becomes lower than the wait temperature $T_W$.

On the other hand, if YES at step S706, i.e., the head temperature $T_H$ is lower than the wait temperature $T_W$, the detection of the head temperature $T_H$ is ended (step S707), then the carriage 4 as shown in FIG. 1 starts main scanning toward the arrow S1 direction (forward direction) (step S708).

The carriage 4 which has started the forward main scanning is accelerated and controlled such that the main scanning speed is approximately constant speed before the ink-jet printhead 5 comes to predetermined print (ink discharge) start position.

While the carriage 4 performs the main scanning at the approximately constant speed, the ink-jet printhead 5 performs printing by discharging ink droplets in correspondence with print data stored in the DRAM (step S709).

Thereafter, the carriage 4 is decelerated, and when the forward main scanning is completed and the carriage is stopped, it turns, then performs main scanning in an arrow S2 direction in FIG. 1 (backward direction) (step S710), to return to the carriage home position side.

During the scanning, the medium M is subscan-moved as described in the first embodiment by the length of (256/600) inches (step S711).

As described above, when one reciprocate scanning has been completed, it is determined whether or not image data printing has been already completed (step S712). If NO, the process returns to step S703, to repeat the processing to step S712.

That is, printing by the ink-jet printhead 5, subscanning and the like are repeated until the image data printing is completed while timing of start of main scanning is controlled in correspondence with comparison between the head temperature $T_H$ and the wait temperature $T_W$, which is set within the interval of every main scanning accompanied by printing in accordance with the number of dots to be printed by the printhead 5.

On the other hand, if YES at step S712, the medium M is discharged by drive of the conveyance motor 1 and the like (step S713).

In the present embodiment, by the above construction and control, the head temperature $T_H$ during image printing is maintained at a temperature not to cause the above-described inconveniences. In particular, it is possible to set the different wait temperatures in accordance with the dot density or the number of dots included in the print data, if the main-scanning directional size remains unchanged. Therefore, the temperature rise of the printhead is prevented while keeping the printing throughput as high as possible.

Note that the table shown in FIG. 8 is obtained by a relational expression derived through experiment or several measurements as in the case of the first and second embodiments.

According to the present embodiment, a printed image can be obtained in the fine quality with suppressing reduction of output speed as much as possible while preventing inconveniences due to temperature rise of the printhead, by setting the wait temperature $T_W$ in accordance with the counted result of the dots which depends on the image to be printed by subsequent main scanning accompanied by printing.

In the present embodiment, the 1-path printing method is employed, however, the present invention is applicable to a printing apparatus employing multi-path printing method, such as 2-path or 4-path printing method.

[Other Embodiments]

Note that in the second embodiment, the 1-path printing method is employed in the high speed mode, and the 2-path printing method is employed in the high image quality mode, however, the present invention is not limited to this arrangement. The number of paths in the high speed mode and the high image quality mode may be an arbitrary number.

Further, in the second embodiment, the wait temperature is changed in correspondence with the main-scanning directional size data of print image and the mode data, however, it may be arranged such that the wait temperature is changed only in correspondence with the mode data.

Similarly, the number of modes is not limited to two, i.e., the high speed mode and the high image quality mode, but it may be set in correspondence with printing modes of a particular printing apparatus.

Further, in the above embodiments, printing (ink discharge) by the ink-jet printhead is performed only during the forward main scanning of the carriage, however, it may be arranged such that printing (ink discharge) is also performed during the backward main scanning.

In addition, if it is arranged such that detection means for detecting an environmental temperature is provided in a carriage or the like around the printhead and the wait temperature is changed in correspondence with the detected temperature, the reduction of output speed can be further suppressed.

Further, in the above embodiments, the speed of main scanning of the carriage is approximately constant during printing (ink discharge) by the ink-jet printhead, however, the present invention exerts its effects even if the speed is not approximately constant.

Further, in the above embodiment, the number of ink-jet printheads is one, however, the present invention is not limited to this number. The present invention is applicable to an ink-jet printer having plural ink-jet printheads for color printing by discharging inks in different colors.

In such printer, it may be arranged such that a temperature detection means is provided in the respective ink-jet printheads, and the printer is set to a standby status until the detected temperature of a printhead which is the highest among the printheads becomes lower than the wait temperature.

Further, in the above embodiments, the present invention is applied to the ink-jet printer of so-called serial printing method, in which the ink-jet printhead and the medium are scanned in main scanning and subscanning directions, however, the present invention is applicable to e.g. a so-called full-line type ink-jet printer, in which ink discharge orifices of ink-jet printhead are arrayed in a length equal to or longer than that of print medium having the maximum available size, only the medium moves, and printing is performed during the movement.

In such full-line type ink-jet printer, it may be arranged such that the start of new movement of medium accompanied by printing (ink discharge) is delayed (the printer is set to a standby status) until the detected temperature of the ink-jet printhead becomes lower than the wait temperature set in correspondence with the length of print image in the medium movement direction or the like.

Further, in the full-line type ink-jet printer, it may be arranged such that a diode sensor or the like to detect the temperature of the ink-jet printhead is provided in plural positions, and the start of new movement of medium accompanied by printing (ink discharge) is delayed (the printer is set to a standby status) until the maximum value or mean value of the detected temperatures becomes lower than the wait temperature.

Further, the present invention is applicable to printing apparatus of printing methods other than the ink-jet method, such as a thermal printer printer. Further, the present invention is applicable to apparatuses having a function of performing printing by a printhead other than an ink-jet printhead.

Further, the present invention is applicable to printing apparatus of printing methods other than the ink-jet method, such as a thermal printer. Further, the present invention is applicable to apparatuses having a function of performing printing by a printhead other than an ink-jet printhead.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, not only an exchangeable chip type printhead, as described in the above embodiments, which can be electrically connected to the apparatus main unit and can receive ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

The present invention can be applied to a system constituted by a plurality of devices (e.g., a host computer, an interface, a reader and a printer) or to an apparatus comprising a single device (e.g., a copy machine or a facsimile machine).

Further, the object of the present invention can be also achieved by providing a storage medium storing software program code for performing the aforesaid processes to a system or an apparatus, reading the program code with a computer (e.g., CPU, MPU) of the system or apparatus from the storage medium, then executing the program.

In this case, the program code read from the storage medium realizes the functions according to the embodiments, and the storage medium storing the program code constitutes the invention.

Further, the storage medium, such as a floppy disk, a hard disk, an optical disk, a magneto-optical disk, a CD-ROM, a CD-R, a DVD, a magnetic tape, a non-volatile type memory card, and ROM, can be used for providing the program code.

Furthermore, besides the aforesaid functions according to the above embodiments being realized by executing the program code which is read by a computer, the present invention includes a case where an OS (operating system) or the like working on the computer performs a part of or entire actual processing in accordance with designations of the program code and realizes functions according to the above embodiments.

Furthermore, the present invention also includes a case where, after the program code is written in a function expansion card which is inserted into the computer or in a memory provided in a function expansion unit which is connected to the computer, a CPU or the like contained in the function expansion card or unit performs a part of or entire actual processing in accordance with designations of the program code and realizes the functions of the above embodiments.

If the present invention is realized as a storage medium, program code corresponding to the above-mentioned flowcharts (shown in FIG. 3 and/or FIG. 7) is to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus in which a printhead and a print medium intermittently move relatively to each other, and during a relative movement, the printhead performs printing on the print medium, comprising:

temperature detection means for detecting a temperature of the printhead;

comparison means for comparing the temperature detected by said temperature detection means with a predetermined threshold value;

control means for controlling start of new relative movement accompanied by printing in correspondence with the result of comparison by said comparison means; and threshold value setting means for setting the threshold value in correspondence with information regarding the number of pixels for which the printhead performs printing during one relative movement.

2. The printing apparatus according to claim 1, wherein said control means controls the new relative movement accompanied by printing not to be started while the temperature is equal to or higher than the threshold value.

3. The printing apparatus according to claim 1, wherein said threshold value setting means includes a table of correspondence between the information and the threshold value.

4. The printing apparatus according to claim 1, wherein the information is information on a length in a direction of relative movement of an area in which the printhead performs printing during the one relative movement.

5. The printing apparatus according to claim 1, wherein the information is information based on whether a printing mode for divisionally printing an area where the printhead can perform printing during the one relative movement with printing during plural relative movements is set or not.

6. The printing apparatus according to claim 1, wherein the information is information based on a division number of divisional printing when an area where the printhead can perform printing during the one relative movement is printed by printing during plural relative movements.

7. The printing apparatus according to claim 1, wherein the information is information based on a maximum number of dots for which the printhead can perform printing during the one relative movement.

8. The printing apparatus according to claim 1, further comprising environmental temperature detection means for detecting an environmental temperature around the printhead, wherein said threshold value setting means sets the threshold value in correspondence with the information and the environmental temperature.

9. The printing apparatus according to claim 1, comprising plural printheads, wherein said temperature detection means is provided in respective printheads, and wherein said comparison means compares a maximum detected temperature with the threshold value.

10. The printing apparatus according to claim 1, wherein the printhead performs printing by utilizing thermal energy.

11. The printing apparatus according to claim 1, wherein the printhead is an ink-jet printhead for performing printing by discharging ink.

12. The printing apparatus according to claim 1, wherein the setting by said threshold value setting means and the comparing by said comparison means are performed before the start of the new relative movement.

13. A printhead temperature management method for a printing apparatus in which a printhead and a print medium intermittently move relatively to each other, and during a relative movement, the printhead performs printing on the print medium, comprising:

a temperature detection step of detecting a temperature of the printhead;

a comparison step of comparing the temperature detected in said temperature detection step with a predetermined threshold value;

a control step of controlling start of new relative movement accompanied by printing in correspondence with the result of comparison in said comparison step; and a threshold value setting step of setting the threshold value in correspondence with information regarding the number of pixels for which the printhead can perform printing during one relative movement.

14. The printhead temperature management method according to claim 13, wherein at said control step, the new relative movement accompanied by printing is controlled not to be started while the temperature is equal to or higher than the threshold value.

15. The printhead temperature management method according to claim 13, wherein the information is information on a length in a direction of relative movement of an area in which the printhead performs printing during the one relative movement.

16. The printhead temperature management method according to claim 13, wherein the information is information based on whether a printing mode for printing an area where the printhead can perform printing during the one relative movement with printing during plural relative movements is set or not.

17. The printhead temperature management method according to claim 13, wherein the information is information based on a division number of divisional printing when an area where the printhead can perform printing during the one relative movement is printed by printing during plural relative movements.

18. The printhead temperature management method according to claim 13, wherein the information is information based on a maximum number of dots for which the printhead can perform printing during the one relative movement.

19. The printhead temperature management method according to claim 13, further comprising an environmental temperature detection step of detecting an environmental temperature around the printhead, wherein in said threshold value setting step, the threshold value is set in correspondence with the information and the environmental temperature.

20. The printhead temperature management method according to claim 13, wherein the printing apparatus comprises plural printheads, and wherein in said temperature detection step, temperatures of respective printheads are detected, further wherein in said comparison step, a maximum detected temperature is compared with the threshold value.

21. The printhead temperature management method according to claim 13, wherein said threshold value setting step and said comparison step are performed before the start of the new relative movement.

22. A computer program product for realizing a printhead temperature management method for a printing apparatus in which a printhead and a print medium intermittently move relatively to each other, and during a relative movement, the printhead performs printing on the print medium, said program product comprising program code corresponding to:

a temperature detection step of detecting a temperature of the printhead;

a comparison step of comparing the temperature detected in said temperature detection step with a predetermined threshold value;

a control step of controlling start of new relative movement accompanied by printing in correspondence with the result of comparison in said comparison step; and a threshold value setting step of setting the threshold value in correspondence with information regarding the number of pixels for which the printhead can perform printing during one relative movement.

23. A storage medium holding a computer program code for realizing a printhead temperature management method for a printing apparatus in which a printhead and a print medium intermittently move relatively to each other, and during a relative movement, the printhead performs printing on the print medium, said storage medium holding program code corresponding to:

a temperature detection step of detecting a temperature of the printhead;

a comparison step of comparing the temperature detected in said temperature detection step with a predetermined threshold value;

a control step of controlling start of new relative movement accompanied by printing in correspondence with the result of comparison in said comparison step; and a threshold value setting step of setting the threshold value in correspondence with information regarding the number of pixels for which the printhead can perform printing during one relative movement.

* * * * *

UNITED STATES PATENT AND TRADEMARK OFFICE

CERTIFICATE OF CORRECTION

PATENT NO. : 6,655,772 B2
DATED : December 2, 2003
INVENTOR(S) : Danzuka et al.

It is certified that error appears in the above-identified patent and that said Letters Patent is hereby corrected as shown below:

Column 11,
Lines 39-44, should read as follows:

--Further, in the first and second embodiments, the electrothermal transducers are provided in the ink channels communicated with the discharge orifices of the ink-jet printhead, ink is partially heated to cause film boiling by energizing the electrothermal transducer, and the ink is discharged by the pressure of the film boiling. However, the present invention is not limited to this type of ink-jet printer but applicable to other types of ink-jet printers.--.

Signed and Sealed this

Twenty-eighth Day of December, 2004

JON W. DUDAS
*Director of the United States Patent and Trademark Office*